United States Patent [19]

Foshee

[11] Patent Number: 4,667,994

[45] Date of Patent: May 26, 1987

[54] FRANGIBLE SPINDLE

[75] Inventor: William R. Foshee, Noblesville, Ind.

[73] Assignee: Best Lock Corporation, Indianapolis, Ind.

[21] Appl. No.: 826,843

[22] Filed: Feb. 6, 1986

[51] Int. Cl.[4] ..... E05C 1/16

[52] U.S. Cl. ..... 292/358; 292/1; 70/422

[58] Field of Search ..... 242/358, 359, 169.22, 242/1; 70/422

[56] References Cited

U.S. PATENT DOCUMENTS

| | | | |
|---|---|---|---|
| 1,308,521 | 7/1919 | Butter | 70/422 X |
| 1,472,481 | 10/1923 | Lockwood | 292/358 |
| 2,702,204 | 2/1955 | Collier | 292/358 X |
| 4,471,984 | 9/1984 | Bellantuono | 292/358 X |
| 4,502,720 | 3/1985 | Fayerman et al. | 292/359 X |

*Primary Examiner*—Richard E. Moore

*Attorney, Agent, or Firm*—Barnes & Thornburg

[57] ABSTRACT

A spindle assembly is provided for retracting a latch bolt of a lock set having separate independently rotatable inside and outside latch bolt-retracting hubs. The spindle assembly includes an inside spindle for operating the inside hub, an outside spindle for operating the outside hub, and a connection member for rotatably interconnecting the inside and outside spindles. The outside spindle includes an inner spindle portion for engaging the outside hub, an outer spindle portion for supporting a lever handle or the like, and a frangible portion interconnecting the inner and outer portions. The frangible portion is configured to transmit spindle-twisting torque from the outer spindle portion to the inner spindle portion in response to application of a torque in excess of a first predetermined amount. The frangible portion is also configured to break at a shear plane in response to application of a torque in excess of a second greater predetermined amount to the outer spindle portion of the outside spindle while the inner spindle portion is fixed against rotation.

19 Claims, 8 Drawing Figures

FRANGIBLE SPINDLE

BACKGROUND AND SUMMARY OF THE INVENTION

This invention relates to lock mechanisms having lock-operating spindles, and particularly to a frangible spindle that is configured to break at a predetermined location under an applied torque during an attack on the lock thereby inhibiting unauthorized access to the lock mechanism.

Conventional lock mechanisms, such as mortise locks, include a lock-operating spindle assembly having an inside spindle and an outside spindle rotatably coupled to the inside spindle. Typically, the inside spindle is coupled to a latch bolt-retracting inside hub and the outside spindle is coupled to a separate latch bolt-retracting outside hub. Generally, the inside hub is never locked so that the lock mechanism can always be operated by a user in the secured area during an emergency. The outside spindle generally carries a lever handle or the like.

A torque can be applied to the lever handle to fracture the outside spindle during an attack on the lock mechanism. Once the outside spindle is fractured and the lever handle separated from the lock mechanism, th attacker can apply an inwardly directed axial force to the exposed portion of the fractured outside spindle in an attempt to push the entire spindle assembly inwardly through the outside and inside hubs to expose the unlocked inside hub. Once exposed, the attacker can insert a tool into the unlocked inside hub and rotate or otherwise operate the hub by means of the tool to retract the latch bolt, thereby violating the security of the lock mechanism.

Heretofore, it has been known to provide an outside spindle having a cross-sectional area that is larger than the cross-sectional area of the inside spindle so that the an outside spindle defines an enlarged end face. The enlarged end face is formed on the end of the outside spindle that is rotatably connected to the comparatively smaller inside spindle and is larger than an inside spindle-receiving aperture formed in the inside hub. Although the comparatively smaller inside spindle will slide freely within the aperture formed in the inside hub to permit assembly, the enlarged end face of the outside spindle will engage the inside hub if the outside spindle is moved in a direction toward the inside hub during an attack. Thus, the enlarged end face blocks movement of a fractured outside spindle through the inside hub.

One problem with this known spindle assembly is that two different cross-sectional sizes of spindle stock must be provided and machined to make the inside spindle and the comparatively larger outside spindle. Further, the inside and outside latch bolt-retracting hubs must be formed with differently sized spindle-receiving apertures to accept the differently sized spindles. Installation can only be accomplished by inserting the inside spindle through the outside hub prior to engaging the inside spindle on the inside hub due to the enlarged cross-sectional area of the outside spindle. These requirements necessarily increase the costs and complicate the manufacture and assembly of known lock sets.

According to the present invention, a spindle assembly is provided for retracting a latch bolt of a lock set having separate independently rotatable inside and outside latch bolt-retracting hubs. The spindle assembly includes an inside spindle for operating the inside hub, an outside spindle for operating the outside hub, and means for rotatably interconnecting the inside and outside spindles. The outside spindle includes an inner spindle portion for engaging the outside hub, an outer spindle portion for supporting a lever handle or the like, and a frangible portion interconnecting the inner and outer portions.

The frangible portion is configured to transmit torque from the outer spindle portion to the inner spindle portion in response to application of a torque in excess of a first predetermined amount. This torque transmission twists the inner spindle portion to define means for blocking movement of the inner spindle portion through an axial spindle-receiving hole in the outside operating hub.

The frangible portion is also configured to break at a shear plane in response to application of a torque in excess of a second predetermined amount to the outer spindle portion of the outside spindle while the inner spindle portion is fixed against rotation. The second predetermined amount is greater than the first predetermined amount. The shear plane is located a predetermined distance away from the inside spindle.

The blocking means defined by twisting the inner spindle portion include a plurality of wedge members which are movable to block movement of the inner spindle portion through an axial spindle-receiving hole in the outside operating hub. The configuration of the frangible portion operates to define an effective size of the blocking wedges. The predetermined distance between the shear plane and the inside spindle is selected to maximize the effective size of each of the plurality of the blocking wedges.

In preferred embodiments of the present invention, the outside spindle is square or rectangular in cross-section and includes a plurality of stress risers such as notches which cooperate to define the shear plane. The cross-sectional area of the outside spindle at the shear plane is either smaller or weaker in comparison with the cross-sectional area of the rest of the outside spindle. In addition, the cross-sectional area at the shear plane must be large enough in comparison with the cross-sectional area of the rest of the outside spindle to transmit sufficient torque from the outer spindle portion to the inner spindle portion so that the inner spindle portion is twisted to define blocking means having at least a minimum effective size.

One feature of the present invention is the provision of a frangible portion configured to break at a shear plane located a predetermined distance away from the inside spindle. This feature advantageously defines the location at which the outside spindle will break under an applied torque, thereby ensuring that the portion of the fractured, twisted outside spindle remaining coupled to the outside hub following an attack will be of sufficient length to maximize the effective size of each of the twisted blocking wedges.

Another feature of the present invention is the provision of a frangible portion configured to undergo at least a predetermined amount of plastic deformation under an applied torque prior to fracture. This feature advantageously defines means for blocking movement of the inner spindle portion through the axial spindle-receiving hole in the inside and outside operating hubs thereby inhibiting access to the inside operating hub during an attack on the security of the lock.

Increasing the effective size of the twisted blocking wedges advantageously increases the "push-through" resistance of the outside spindle in relation to the outside and inside latch bolt-retracting hubs. Thus, an increase in the effective size of the twisted blocking wedges proportionately increases the threshold level of the amount of axially inwardly directed force that must be applied to the fractured outside spindle to push the outside spindle through the apertures in the outside inside hubs to expose the inside hub to attack. This feature advantageously reduces the likelihood that an attacker can gain access to the inside hub by fracturing and then applying force to the outside spindle.

Advantageously, the efficacy of the foregoing novel blocking feature is wholly independent of the cross-sectional size of the inside and outside spindles. Therefore, the inside and outside spindles of the present invention as well as the spindle-receiving apertures of both the inside and outside hubs can have the same cross-sectional area to avoid the shortcomings of known lock spindle assemblies.

Additional features and advantages of the invention will become apparent to those skilled in the art upon consideration of the following detailed description of the preferred embodiment exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
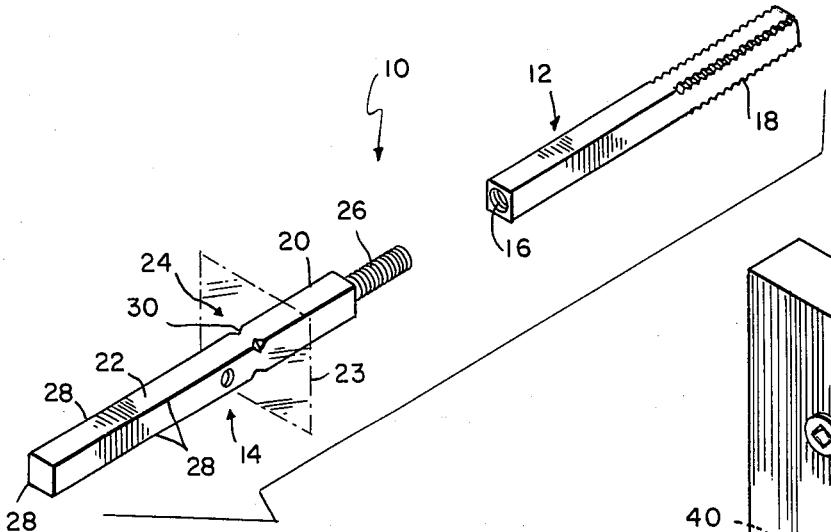
FIG. 1 is a perspective assembly view of the novel spindle assembly of the present invention.

Referring to FIG. 1, the spindle assembly 10 of the present invention includes an inside spindle 12 and an outside spindle 14. Both of the spindles 12, 14 are desirably made from the same spindle stock so that they have substantially equivalent cross-sectional areas. However, it will be understood that such equivalence is not necessary to practice the present invention.

The inside spindle 12 includes an axial bore 16 and conventional external knob-mounting threads 18. The outside spindle 14 includes an inner spindle portion 20, an outer spindle portion 22, and a frangible portion 24 extending therebetween. A threaded rod 26 is integrally fixed to the distal end of the inner spindle portion as shown in FIG. 1 for insertion into the axial bore 16 of the inside spindle 12. The threaded rod 26 interconnects the spindles 10, 12 and also permits independent rotation of each spindle even though the spindles 10, 12 are joined together by rod 26.

The outer spindle portion 22 is desirably a rectangular parallelopiped having four longitudinally extending peripheral corner edges 28. Each of the corner edges 28 is cut away in the frangible portion 24 to define a like number of circumferentially spaced notches 30 as shown best in FIGS. 1 and 3. The notches 30 cooperate to define a region having a cross-sectional area that is smaller and weaker by comparison to the uniform cross-sectional area of the remainder of the outside spindle 14. A transverse shear plane 23 is defined along the longitudinal axis of the outside spindle 14 at the point in the frangible portion 24 where the transverse cross-sectional area is the smallest. It will be appreciated that there are many ways other than the way just described of forming the frangible portion 24 to provide a region of reduced cross-sectional area. In addition, it will be appreciated that a comparatively weakened section could be defined by heat treating the frangible portion differently than the remaining portion of the outside spindle to lessen the stiffness of a selected fracture region within the frangible portion. Such treatment would eliminate the need to provide a region of reduced cross-sectional area.

The spindle assembly 10 is adaptable for use in many locking systems and may be installed in a wide variety of lock sets to interconnect lever handles, knobs, or the like and rotatable lock-operating hubs so that rotation of the handle operates to retract the latch bolt to open the door. Reference is made to U.S. patent application Ser. No. 06/607,007, filed May 4, 1984, which shows a suitable mortise lock set into which the novel spindle assembly of the present invention may be installed.

Figure 2:
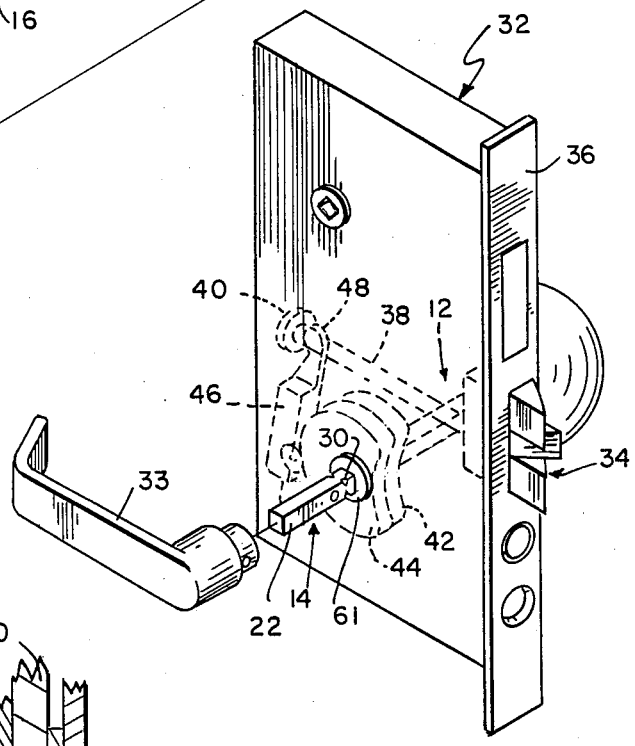
FIG. 2 is a perspective view of the spindle assembly shown in FIG. 1 when mounted in a mortise lock set.

As shown in FIG. 2, the spindle assembly 10 is installed in a box-like mortise lock case 32. A lever handle 33 is mounted on the outer spindle portion 22 by means of a captured pin (not shown) received in pin-receiving holes formed in the outer spindle portion 22 and the lever handle 33. A latch bolt 34 projects through a front edge face member 36 of the case 10 and has a rearwardly extending tailpiece 38. The tailpiece 38 carries a tail plate 40 at its rear end.

An inside lock-operating hub 42 and an outside lock-operating hub 44 are mounted coaxially in the case 32 for independent rotation. A central aperture is formed in each hub 42, 44 for receiving an innermost end of each of the inside and outside spindles 12, 14. Thus, the outside lever 33 is coupled by means of the outside spindle 14 to rotate the outside lock-operating hub 44 and the inside knob is coupled by means of the inside spindle 12 to rotate the inside lock-operating hub 42.

A retraction lever 46 is pivotally mounted in the case 32 to extend upwardly past the hubs 42 and 44. The retraction lever 46 is formed at its upper end with a lever nose 48 which is positioned in engagement with the tail plate 40 of the tailpiece 38. Each hub 42 or 44 may be rotated from the position shown in FIG. 2 to force the retraction lever 46 to pivot rearward so that its nose 48 forces the tail plate 40 and the tailpiece 38 of the latch bolt 34 to a retracted position. At this point, the door in which the mortise lock is mounted may be opened.

Figure 3:
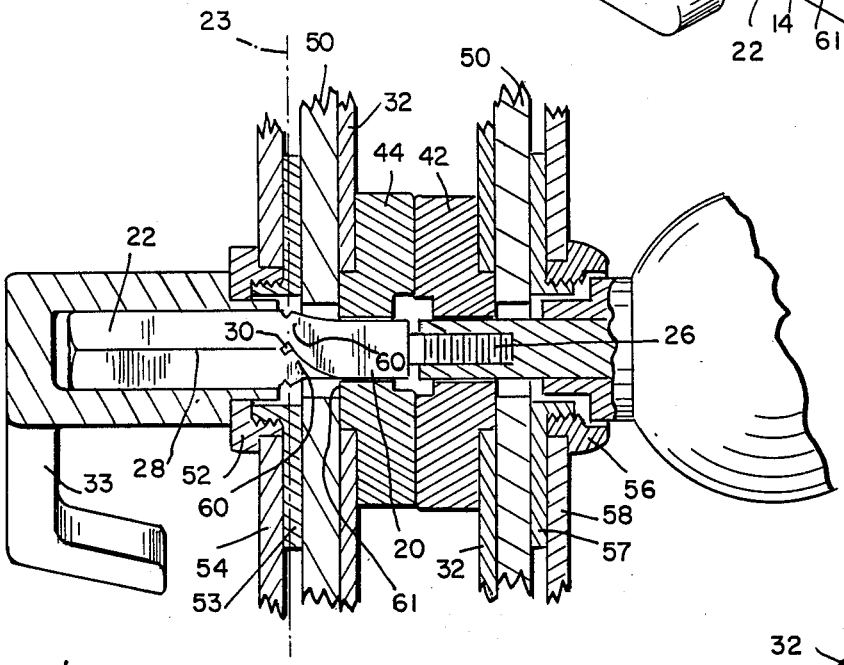
FIG. 3 is a sectional detail view showing twisting deformation of the outside spindle in response to application of a torque to the exposed lever handle.

The lock set case 32 is mounted in a door 50 in the customary way as shown in FIG. 3. The outside mounting assembly includes an outside escutcheon ring 52, an outside chassis 53, and an outside rose ring 54. The outside lever handle 33 is attached to the outer spindle portion 22 by means of a separate coupling pin (not shown). The inside mounting assembly includes an inside escutcheon ring 56, an inside chassis 57, and an inside rose ring 58. The inside knob is attached to the external knob-mounting threads 18 of the inside spindle 12 in the customary way.

As shown in FIG. 3, the innermost end of the square inner spindle portion 20 is positioned in the square hole formed in the outside lock-operating hub 44. Thus, the inner spindle portion 20 is fixed against rotation in relation to the outside hub 44. The outer spindle portion 22 is almost entirely received within a mounting portion of the lever handle 33. Importantly, the shear plane 23 defined by the notches 30 formed in the frangible portion 24 is positioned in proximity to the door 50 as shown in FIG. 3 to shelter the inner spindle portion 20 substantially within the door 50 and the case 32 following separation of the inner and outer spindle portions 20, 22 at the shear plane 23.

The novel outside spindle 14 is configured to include a central weak frangible section to, in effect, protect the inner spindle portion 20 from breakage during an attack. In particular, the central weak section has a comparatively smaller cross-sectional area than the rest of the outside spindle 14 and will itself: (1) transmit spindle-twisting torque from the outer spindle portion 22 to the inner spindle portion 20 in response to application of a torque in excess of a first predetermined amount to the outer spindle portion 22 via the lever handle 33, and (2) fail before the adjacent twisting inner spindle portion 20 fails in response to application of a torque in excess of a greater second predetermined amount to the outside spindle 14 via the lever handle 33.

Figure 5:
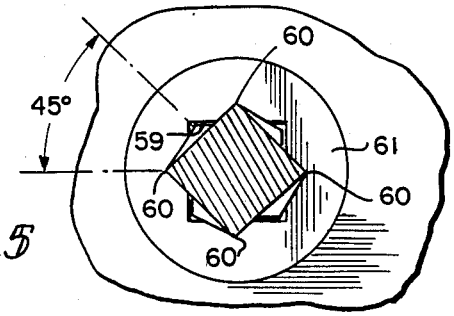
FIG. 5 is a front plan view of the fractured outside spindle portion shown in FIG. 4 showing the position of the blocking wedges relative to an outer face of the outside bolt-retracting hub.
Figure 4:
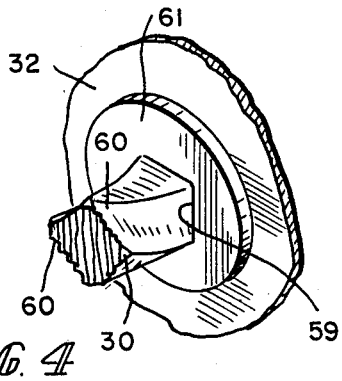
FIG. 4 is an enlarged perspective view of the outside spindle shown in FIG. 2 after the outside spindle has been fractured along the shear plane.

As can be seen in FIG. 3, application of such a torque causes the end section of the inner spindle portion 20 that is not fixed to the outside lock-operating hub 44 to twist about the longitudinal axis of the outside spindle 14. As a result, each of the corner edges 28 is likewise twisted to define a like plurality of elongated, contoured blocking wedges 60 as shown in FIGS. 3–5.

In effect, the corner edges 28 of the inner spindle portion 20 that are not fixed in the outside hub 44 are rotated about 45° from an initial position (see FIG. 2) within the square profile 59 defined by the square axial spindle-receiving hole formed in the outside hub 44, in pinwheel fashion, to a twisted position (see FIGS. 3–5) at angles to the same square profile 59. The "effective size" of each blocking wedge 60 is determined, in part, by the amount of spindle material extending beyond the profile 59 of the square spindle-receiving apperture and is a function of the magnitude of the "twist angle". As shown in FIG. 5, the "effective size" of each blocking wedge 60 is at a maximum when the outermost end of the inner spindle portion 20 is twisted 45° from its original position within the square hole profile 59.

Stress risers such as notches 30 cooperate to reduce the cross-sectional area of the frangible portion 24 at the shear plane 23, thereby increasing the concentration of torsional stress at the shear plane 23 so that the outside spindle 14 consistently breaks at the shear plane 23 when exposed to a torque in excess of the greater second predetermined amount. When rotated through the "twist angle", the blocking wedges 60 cooperate to define means for blocking movement of the inner spindle portion 20 through the axial hole formed in the inside operating hub 42.

As a result, an attacker is generally unable to push the novel spindle assembly 10 of the present invention through both of the hubs 42 and 44 so that the spindle assembly 10 falls to the ground on the secure side of the door 50. Since the spindle assembly 10 cannot be disassembled in that manner, the lock attacker is unable to gain access to the axial hole formed in the inside operating hub 42 through the adjacent axial hole formed in the outside operating hub 44. Thus, the lock attacker is advantageously prevented from inserting a tool into the inside operating hub 42 from the outside of the door for the purpose of rotating the unlocked inside hub 42 to retract the latch bolt 34.

EXAMPLE

Figure 6:
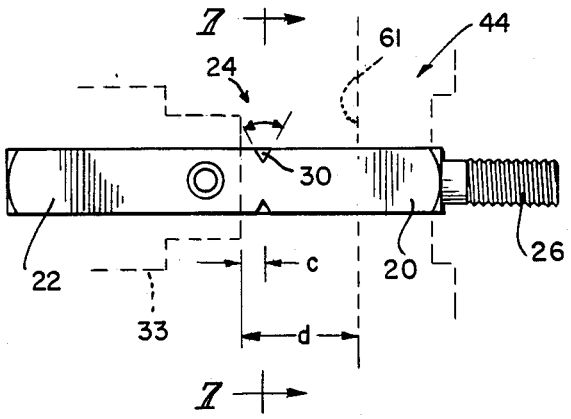
FIG. 6 is a side elevational view of the outer spindle shown in FIG. 1.
Figure 7:
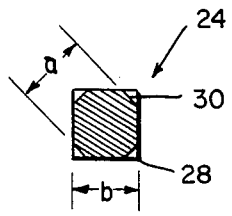
FIG. 7 is a sectional view taken along lines 7—7 of FIG. 6.

An example of a frangible outside spindle 14 constructed in accordance with preferred embodiments of the present invention is illustrated in FIGS. 6 and 7. A portion of the lever handle 33 and the outside operating hub 44 with outside surface 61 are represented by phantom lines and shown in their fully mounted positions. The outer spindle 14 is made of 12L14 cold drawn steel carburized 0.020 in. (0.51 cm) deep to $R_c$ 30–36. Referring to FIG. 7, dimension "a" is about 0.313 in. (0.795 cm) and dimension "b" is about 0.375 in. (0.750 cm). The preferred depth of notches 30 can be calculated using dimensions "a" and "b". Referring to FIG. 6, dimension "c" and represents the distance between the innermost face of the lever handle 33 and the shear plane 23. Dimension "d" represents the distance between the outermost face 61 of the outside lock operating hub 44 and the shear plane 23. The included angle "e" defined by each notch 30 is desirably 60° as shown best in FIG. 6.

Figure 8:
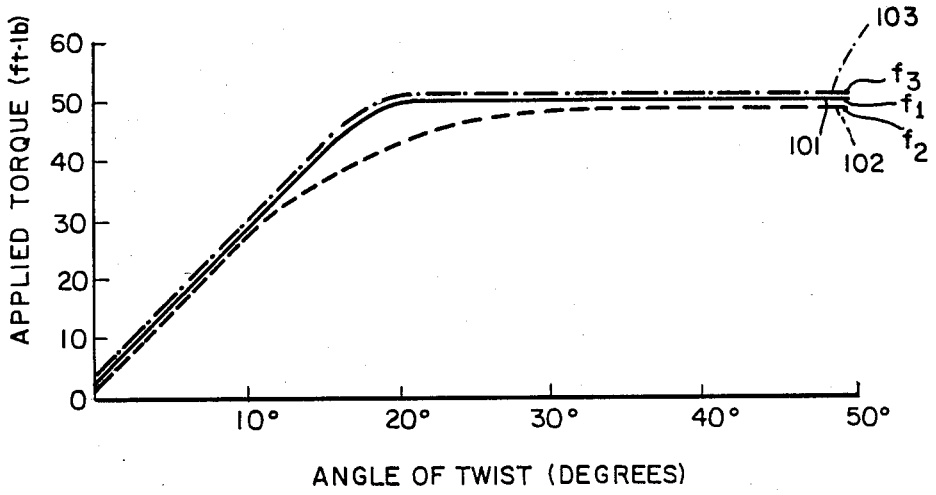
FIG. 8 is a plot of the angle of twist of an inner spindle portion as a function of the torque applied to an outer spindle portion of the outside spindle during a fracture test.

The results of a fracture test involving the outer spindle 14 shown in FIGS. 7 and 8 are illustrated in FIG. 8 which shows a plot of the angle of twist of the twisting portion 60 of the inner spindle portion 20 as a function of the torque applied to the outer spindle portion 22 via the lever handle 33. This graph illustrates how much torque per degree was required to rotate the test spindle to its shear point. The testing was performed using an outside knob or lever handle spindle from the 34/35H series of mortise locks available from Best Lock Corporation, Indianapolis, Ind. Rupture point "f" represents the point at which the outer spindle 14 fractures along shear plane 23 and breaks into two separate portions. The spindle has a stress riser machined on is surface to make the spindle twist and shear in the proper location and to prevent overpowering the case locking mechanism. The test spindle twisted about 70 degrees before shearing off at the stress riser to yield a twisted stub protruding from the outside hub. Advantageously, this stub prevents an attacker from pushing the spindle through the inside hub and rotating the inside hub with a screwdriver to retract the latch.

The data illustrated in FIG. 8 was obtained in the following manner. A Best Lock Corporation Series 34H mortise lock and trim was installed in a test fixture. The fixture has a protractor drawn on it. The center of the protractor originated from the axis of the spindle with zero degrees pointing directly vertical. The outside knob was locked and a torque adapter was installed on the outside knob. A foot-pound torque meter was used to apply the torque in the clockwise direction. The torque meter was read at every ten degree increment as the torque was applied to the spindle. The test procedure was repeated three times to obtain rupture points $f_1$, $f_2$, and $f_3$ and to obtain an average value of the amount of torque necessary to rupture the spindle. Plots 101, 102, and 103 represent the data gathered in tests one, two, and three, respectively.

Although the invention has been described in detail with references to certain preferred embodiments and specific examples, variations and modifications exist within the scope and spirit of the invention as described and defined in the following claims.

What is claimed is:

1. A lock comprising a case, a latch bolt movable in the case between a retracted position and a projected position, inside and outside operating hubs coaxially aligned and independently rotatably mounted in the case, linkage means for moving the latch bolt between its retracted and projected positions in response to rotation of at least one of the operating hubs, and an outside spindle for rotating the outside operating hub, the outside spindle including an inner spindle portion coupled to the outside operating hub, an outer spindle portion for supporting a lever handle or the like, and a frangible portion interconnecting the inner and outer portions, the frangible portion being configured to break about at a shear plane located a predetermined distance away from the outside operating hub in response to application of a torque in excess of a predetermined amount to the outside spindle so that the outer spindle portion breaks away, leaving the inner spindle portion in coupled relation with the outside operating hub to block access to the inside operating hub during an attack on the lock, wherein the inside and outside operating hubs are each formed to include an axial spindle-receiving hole, the inner spindle portion is a rectangular parallelopiped and includes an integral distal end inserted into the axial spindle-receiving hole of the outside operating hub and a proximal end connected to the frangible portion, the proximal end including four elongated corner regions serially spaced about the longitudinal axis of the inner spindle portion and extending along the inner spindle portion between the shear plane and the outside operating hub, the corner regions being rotatable about the longitudinal axis of the inner spindle portion during twisting deformation of the inner spindle portion to define blocking wedges to prevent passage of the proximal end of the inner spindle portion through the spindle-receiving hole of the outside operating hub.

2. The lock of claim 1, wherein the frangible portion includes means for increasing the concentration of torsional stress at the shear plane so that the outside spindle consistently breaks at the shear plane when exposed to a torque in excess of the predetermined amount.

3. A lock comprising a case, a latch bolt movable in the case between a retracted position and a projected position, inside and outside operating hubs coaxially aligned and independently rotatably mounted in the case, linkage means for moving the latch bolt between its retracted and projected positions in response to rotation of at least one of the operating hubs, and an outside spindle for rotating the outside operating hub, the outside spindle including an inner spindle portion coupled to the outside operating hub, an outer spindle portion for supporting a lever handle or the like, and a frangible portion interconnecting the inner and outer portions, the frangible portion being configured to break about at a shear plane located a predetermined distance away from the outside operating hub in response to application of a torque in excess of a predetermined amount to the outside spindle so that the outer spindle portion breaks away, leaving the inner spindle portion in coupled relation with the outside operating hub to block access to the inside operating hub during an attack on the lock, wherein the outside spindle is a rectangular parallelopiped having four longitudinal peripheral edges and a notch formed in each of the peripheral edges, all four notches intersecting the shear plane to increase the concentration of torsional stress at the shear plane so that the outside spindle consistently breaks at the shear plane when exposed to a torque in excess of the predetermined amount.

4. The lock of claim 3, wherein the inside and outside spindle portions have substantially equivalent cross-sectional areas and the notches cooperate to define a fracture region having a cross-sectional area that is less than the cross-sectional area of the inside and outside spindle portions.

5. A lock comprising a case, a latch bolt movable in the case between a retracted position and a projected position, inside and outside operating hubs coaxially aligned and independently rotatably mounted in the case, linkage means for moving the latch bolt between its retracted and projected positions in response to rotation of at least one of the operating hubs, and an outside spindle for rotating the outside operating hub, the outside spindle including an inner spindle portion coupled to the outside operating hub, an outer spindle portion for supporting a lever handle or the like, and a frangible portion interconnecting the inner and outer portions, the frangible portion being configured to break about at a shear plane located a predetermined distance away from the outside operating hub in response to application of a torque in excess of a predetermined amount to the outside spindle so that the outer spindle portion breaks away, leaving the inner spindle portion in coupled relation with the outside operating hub to block access to the inside operating hub during an attack on the lock, wherein the inside and outside operating hubs are each formed to include an axial spindle-receiving hole, the inner spindle portion includes a proximal end connected to the frangible portion and an integral distal end inserted into the axial spindle-receiving hole of the outside operating hub, the proximal end providing means for blocking movement of the inner spindle portion through the axial hole in the inside operating hub in response to application of a torque in excess of the predetermined amount to the outside spindle so that an attacker is unable to gain access to the axial hole in the inside operating hub through the axial hole in the outside operating hub.

6. The lock of claim 5, wherein the frangible portion is defined by a necked-down segment such that application of a torque in excess of the predetermined amount operates to break the necked-down segment to separate the outer spindle portion from the inner spindle portion.

7. The lock of claim 5, further comprising an inside spindle for rotating the inside operating hub and means for interconnecting the inner spindle portion of the outside spindle and the inside spindle, the cross-sectional shapes of the inside and outside spindles being substantially equivalent.

8. The lock of claim 1, wherein the outside operating hub includes an innermost face presented toward the inside operating hub and an opposite outermost face, and the blocking wedges engage the outermost face of the outside operating hub in response to forced axial movement of the proximal end of the inner spindle portion into spindle-receiving hole of the outside operating hub during an attack on the security of the lock.

9. The lock of claim 1, further comprising an inside spindle for rotating the inside operating hub and means for interconnecting the inner spindle portion of the outside spindle and the inside spindle, and the cross-sectional shapes of the inside and outside spindles being substantially equivalent.

10. A lock comprising a case, a latch bolt movable in the case between a retracted position and a projected position, inside and outside operating hubs coaxially aligned and independently rotatably mounted in the case, each operating hub being formed to include an axial spindle-receiving hole, linkage means for moving the latch bolt between its retracted and projected positions in response to rotation of at least one of the operating hubs, shaft means for independently rotating each of the inside and outside hubs, the rotating means including an inside spindle having an inner end, an outside spindle having an inner spindle portion including a coupling portion and a twisting portion, and an outer spindle portion, and means for interconnecting the inner ends of the inside and outside spindles in end-to-end relation, the shaft means being inserted into the spindle-receiving holes of the inside and outside operating hubs to position the coupling portion of the inner spindle portion in the spindle-receiving hole of the outside operating hub so that the twisting portion of the inner spindle portion projects away from the outside operating hub, the twisting portion including a plurality of wedge members for blocking movement of the inner spindle portion of the outside spindle through the axial spindle-receiving hole in the outside operating hub in response to application of a torque in excess of a predetermined amount to the outside spindle, the twisting portion being configured to break apart from the outer spindle portion at a shear plane located a predetermined distance away from the outside operating hub to define the length of the twisting portion, thereby maximizing the effective size of each of the plurality of blocking wedges.

11. The lock of claim 10, wherein the twisting portion includes means for increasing the concentration of tortional stress at the shear plane so that the outside spindle consistently breaks at the shear plane when exposed to a torque in excess of the predetermined amount.

12. The lock of claim 10, wherein the outside spindle is a rectangular parallelopiped having four longitudinal peripheral edges and a notch formed in each of the peripheral edges, all four notches intersecting the shear plane to increase the concentration of the tortional stress at the shear plane so that the outside spindle consistently breaks at the shear plane when exposed to a torque in excess of the predetermined amount.

13. The lock of claim 10, further comprising an inside spindle for rotating the inside operating hub and means for interconnecting the inner spindle portion of the outside spindle and the inside spindle, the cross-sectional shapes of the inside and outside spindles being substantially equivalent.

14. A lock comprising a case, a latch bolt movable in the case between a retracted position and a projected position, inside and outside operating hubs coaxially aligned and independently rotatably mounted in the case, each operating hub being formed to include an axial spindle-receiving hole, an outside spindle for rotating the outside operating hub, the outside spindle including an inner spindle portion coupled to the outside operating hub, an outer spindle portion for supporting a lever handle or the like, and a frangible portion interconnecting the inner and outer portions, the frangible portion being configured to transmit torque from the outer spindle portion to the inner spindle portion to twist the inner spindle portion in response to application of a torque to the outer spindle portion in excess of a first predetermined amount thereby defining means for blocking movement of the inner spindle portion through the axial spindle-receiving hole in the outside operating hub and to break about at a shear plane located a predetermined distance away from the outside operating hub in response to application of a torque to the outer spindle portion in excess of a second predetermined amount that is greater than the first predetermined amount to define a minimum length of the inner spindle portion thereby maximizing the effective size of the blocking means.

15. The lock of claim 14, wherein the frangible portion includes means for controlling the concentration of tortional stress at the shear plane so that the inner spindle portion is twisted through at least a predetermined angle when exposed to a torque in excess of the first predetermined amount to maximize the effective size of the blocking means and so that the twisted outside spindle consistently breaks about at the shear plane when exposed to a torque in excess of the second predetermined amount to block access to the inside operating hub during an attack on the lock.

16. The lock of claim 14, wherein the outside spindle is a rectangular parallelopiped having four longitudinal peripheral edges and a notch formed in each of the peripheral edges, all four notches intersecting the shear plane to increase the concentration of tortional stress at the shear plane so that the outside spindle consistently breaks about at the shear plane when exposed to a torque in excess of the second predetermined amount.

17. The lock of claim 16, wherein the inside and outside spindle portions have substantially equivalent cross-sectional areas and the notches cooperate to define a fracture region having a cross-sectional area that is less than the cross-sectional area of the inside and outside spindle portions.

18. The lock of claim 17, wherein the cross-sectional area of the fracture region is sized to transmit spindle-twisting torque from the outer spindle portion to the inner spindle portion in response to application of a torque in excess of the first predetermned amount yet less than the second predetermined amount to twist the inner spindle portion without breaking the frangible portion to separate the outer spindle portion from the inner spindle portion.

19. The lock of claim 14, further comprising an inside spindle for rotating the inside operating hub and means for interconnecting the inner spindle portion of the outside spindle and the inside spindle, the cross-sectional shapes of the inside and outside spindles being substantially equivalent.

* * * * *